US012414603B2

(12) United States Patent
Campos, II et al.

(10) Patent No.: US 12,414,603 B2
(45) Date of Patent: Sep. 16, 2025

(54) ARTICLE OF FOOTWEAR INCLUDING A SOLE STRUCTURE

(71) Applicant: Nike, Inc., Beaverton, OR (US)

(72) Inventors: Fidencio Campos, II, Dallas, OR (US); David W. Carter, Portland, OR (US); David M. Forland, Battle Ground, WA (US); Jonathan Kosenick, Beaverton, OR (US); Aaron B. Street, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 219 days.

(21) Appl. No.: 18/188,159

(22) Filed: Mar. 22, 2023

(65) Prior Publication Data

US 2023/0301397 A1 Sep. 28, 2023

Related U.S. Application Data

(60) Provisional application No. 63/322,839, filed on Mar. 23, 2022.

(51) Int. Cl.
*A43B 13/12* (2006.01)
*A43B 13/04* (2006.01)
*A43B 13/20* (2006.01)

(52) U.S. Cl.
CPC ..... *A43B 13/20* (2013.01); *A43B 13/04* (2013.01); *A43B 13/125* (2013.01)

(58) Field of Classification Search
CPC ..... A43B 17/03; A43B 13/203; A43B 13/189; A43B 13/20; A43B 13/125
See application file for complete search history.

(56) References Cited

U.S. PATENT DOCUMENTS 4,183,156 A * 1/1980 Rudy ..... A43B 13/40 36/44
4,219,945 A * 9/1980 Rudy ..... A43B 13/203 36/44
4,670,995 A * 6/1987 Huang ..... B29D 35/14 36/44
4,817,304 A 4/1989 Parker et al.
5,042,176 A * 8/1991 Rudy ..... F16F 1/3615 36/153
5,353,459 A * 10/1994 Potter ..... A43B 17/03 36/71
5,406,719 A * 4/1995 Potter ..... A43B 13/203 36/35 B (Continued)

FOREIGN PATENT DOCUMENTS

EP 0456434 A2 11/1991

OTHER PUBLICATIONS

International Search Report in Application No. PCT/US2023/064813, mailed Aug. 18, 2023 (6 pages).

*Primary Examiner* — Jillian K Pierorazio
(74) *Attorney, Agent, or Firm* — BOOKOFF MCANDREWS PLLC.

(57) ABSTRACT

An article of footwear including an upper and a sole structure. The sole structure includes a midsole, wherein the midsole includes an enclosed cavity, a thermoformed cushioning element disposed within the enclosed cavity, wherein the cushioning element includes an upper barrier film and a bottom barrier film enclosing an internal volume, and an outsole layer, wherein the outsole layer forms a ground-engaging surface of the article of footwear.

20 Claims, 9 Drawing Sheets

(56) References Cited

U.S. PATENT DOCUMENTS

| | | | | |
|---|---|---|---|---|
| 5,755,001 | A * | 5/1998 | Potter | A43B 21/28<br>12/146 B |
| 10,729,206 | B2 | 8/2020 | Campos, II et al. | |
| 2001/0042321 | A1* | 11/2001 | Tawney | A43B 13/20<br>36/43 |
| 2002/0139471 | A1* | 10/2002 | Tawney | B29D 22/02<br>156/205 |
| 2007/0063368 | A1* | 3/2007 | Schindler | A43B 13/189<br>249/134 |
| 2012/0117824 | A1* | 5/2012 | Kim | A43B 13/182<br>36/105 |
| 2013/0318825 | A1* | 12/2013 | Caron | A43B 1/0072<br>36/83 |
| 2015/0327627 | A1* | 11/2015 | Brandt | B29C 66/438<br>36/29 |
| 2017/0035144 | A1* | 2/2017 | Parker | A43B 13/04 |
| 2018/0213887 | A1* | 8/2018 | Brandt | A43B 13/20 |
| 2018/0332923 | A1* | 11/2018 | Ellis | A43B 7/32 |
| 2021/0145120 | A1* | 5/2021 | Campos, II | A43B 13/189 |
| 2021/0368918 | A1* | 12/2021 | Lyke | A43B 13/20 |

* cited by examiner

ARTICLE OF FOOTWEAR INCLUDING A SOLE STRUCTURE

CROSS-REFERENCE TO RELATED APPLICATION(S)

This application claims priority to U.S. Provisional Application No. 63/322,839, filed Mar. 23, 2022, the entirety of which is incorporated herein by reference.

FIELD

The present disclosure relates generally to sole structures for articles of footwear and more particularly to sole structures incorporating a fluid-filled bladder.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase the durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
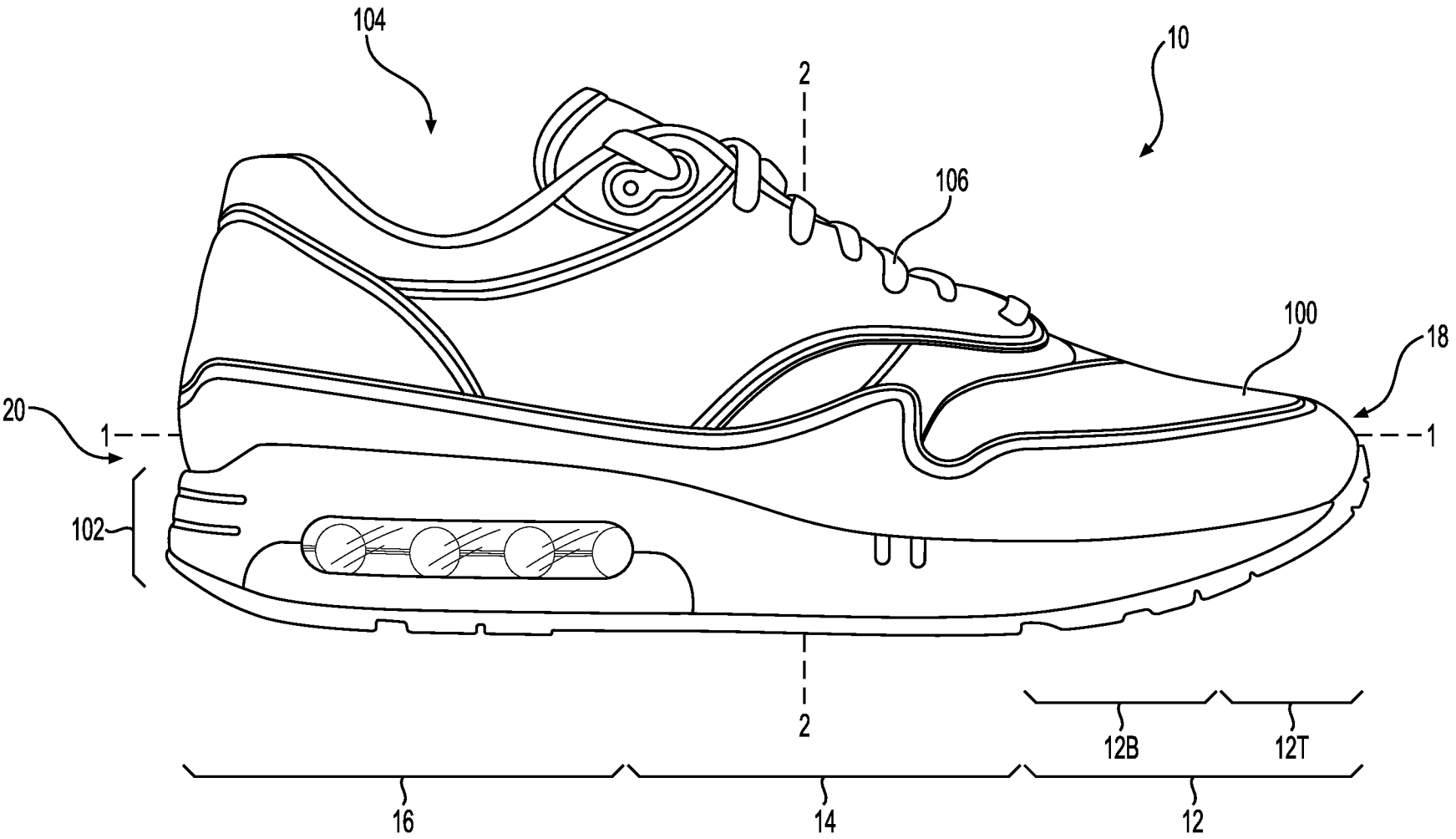
FIG. 1 is a perspective view of an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In the discussion that follows, terms "about," "approximately," "substantially," and the like, when used in describing a numerical value, denote a variation of +/−10% of that value, unless specified otherwise.

Upper

Figure 6:
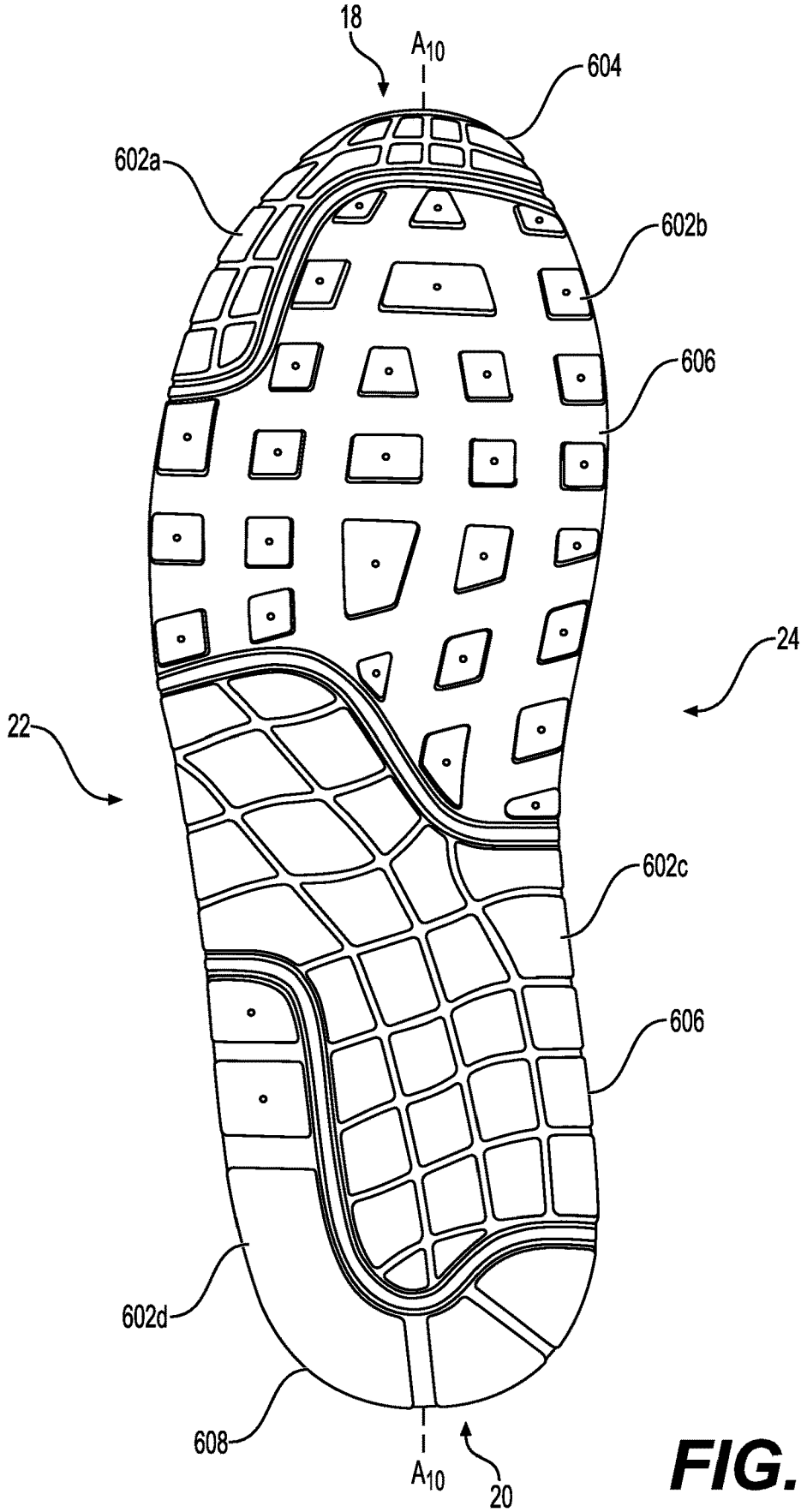
FIG. 6 is a bottom view of a ground-engaging surface of the article of footwear of FIG. 1.

Referring to FIG. 1, an article of footwear 10 may include an upper 100 and a sole structure 102. The article of footwear 10 may be divided into one or more regions. The regions may include a forefoot region 12, a mid-foot region 14, and a heel region 16. The forefoot region 12 may be subdivided into a toe portion 12T corresponding with phalanges, and a ball portion 12B associated with metatarsal bones of a foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region, and a posterior end 20 associated with a rearward-most point of the heel region 16. Referring to FIG. 6, a longitudinal axis $A_{10}$ of the footwear 10 may extend along a length of the footwear 10 from the anterior end 18 to the posterior end 20, and may generally divide the footwear 10 into a lateral side 22 and a medial side 24. Accordingly, the lateral side 22 and the medial side 24 respectively correspond with opposite sides of the footwear 10 and extend through the regions 12, 14, 16.

The upper 100 may include interior surfaces that define an interior void configured to, for example, receive and secure a foot for support on sole structure 102. The upper 100 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, the upper 100 may include a strobel having a bottom surface opposing the sole structure 102 and an opposing top surface defining a footbed of the interior void. Stitching or adhesives may secure the strobel to the upper 100. The footbed may be contoured to conform to a profile of the bottom surface (e.g., plantar) of the foot. Optionally, the upper 100 may also incorporate additional layers such as an insole or sockliner that may be disposed upon the strobel and reside within the interior void of the upper 100 to receive a plantar surface of the foot to enhance the comfort of the article of footwear 10. An ankle opening 104 in the heel region 16 may provide access to the interior void. For example, the ankle opening 104 may receive a foot to secure the foot within the void and facilitate entry and removal of the foot from and to the interior void. In some examples, one or more fasteners 106 may extend along the upper 100 to adjust a fit of the interior void around the foot and to accommodate entry and removal of the foot therefrom. The fasteners 106 may include laces, straps, cords, hook-and-loop, or any other suitable type of fastener. The upper 100 may include a tongue portion that extends between the interior void and the fasteners.

Sole Structure

Figure 2:
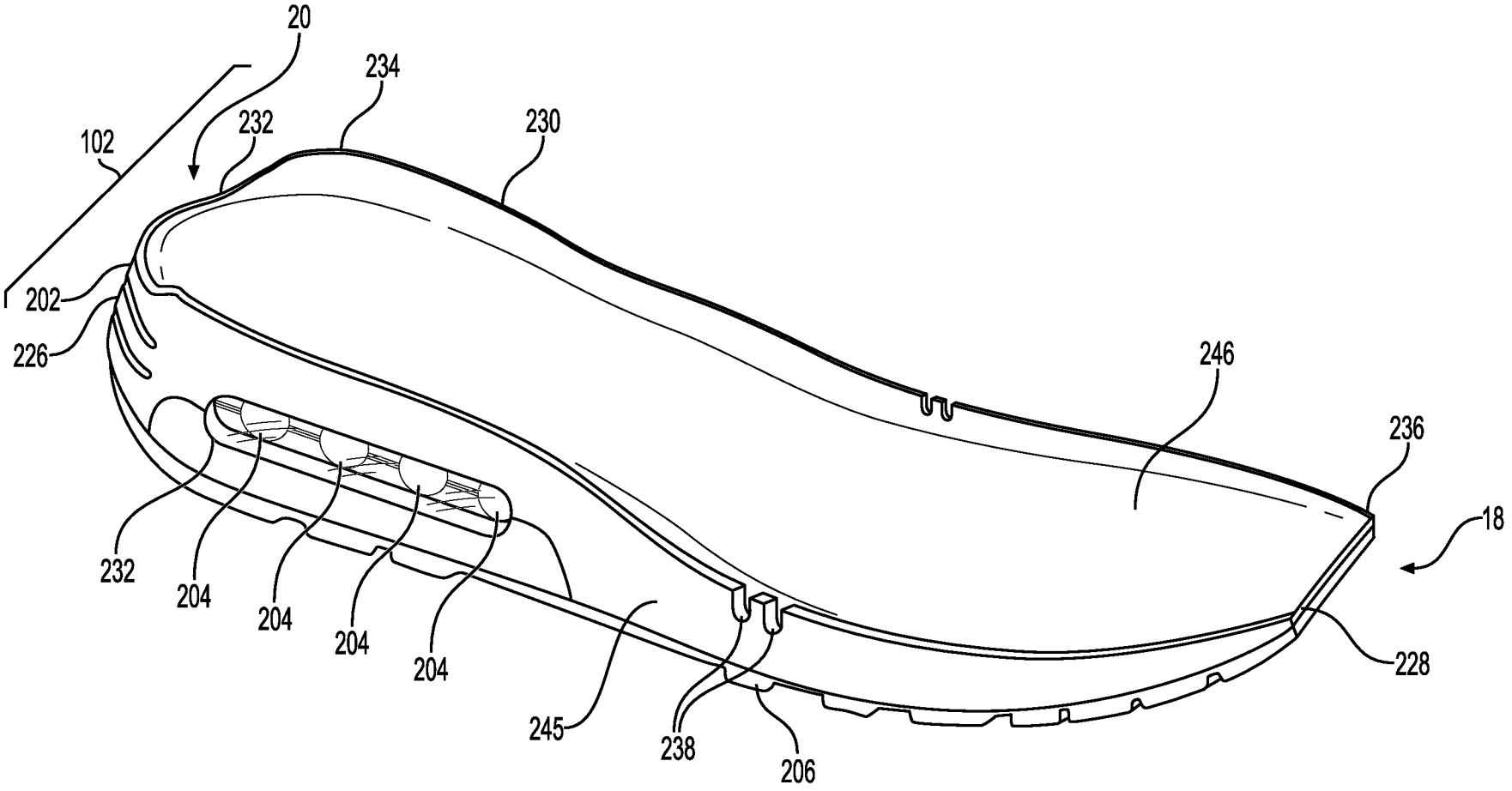
FIG. 2 is a perspective view of a sole structure of the article of footwear of FIG. 1.

With reference to FIG. 2, the sole structure 102 may include a midsole 202 configured to provide cushioning characteristics to the sole structure 102, a cushioning element 204 configured to provide cushioning characteristics to the sole structure 102, and an outsole 206 configured to provide a ground-engaging surface of the article of footwear 10.

Midsole

Referring to FIGS. 2, 3, 5A, and 5B, the midsole 202 may extend continuously from the anterior end 18 to the posterior end 20. The midsole 202 may span width of the article of footwear 10 from the lateral side 24 to the medial side 22. The midsole 202 may include a foam material (e.g. ethylene-vinyl acetate (EVA), polyurethane, or the like.) The midsole 202 may include a top surface 246, a lateral face 245, a bottom surface, an interior cavity 224 (shown in FIG. 3), a heel portion 226, a forefoot portion 228, one or more sidewalls 230, a first foam 223, and a second foam 225. Midsole 202 may also include a medial face 247 opposite the lateral face 245. The medial face 247 may be substantially similar to the lateral face 245. The first foam 223 may be an upper inner foam of the midsole 202 while the article of footwear 10 is at rest with the outsole 206 facing a ground surface. The second foam 225 may be a lower inner foam of the midsole 202 while the article of footwear 10 is at rest with the outsole 206 facing a ground surface.

Figure 3:
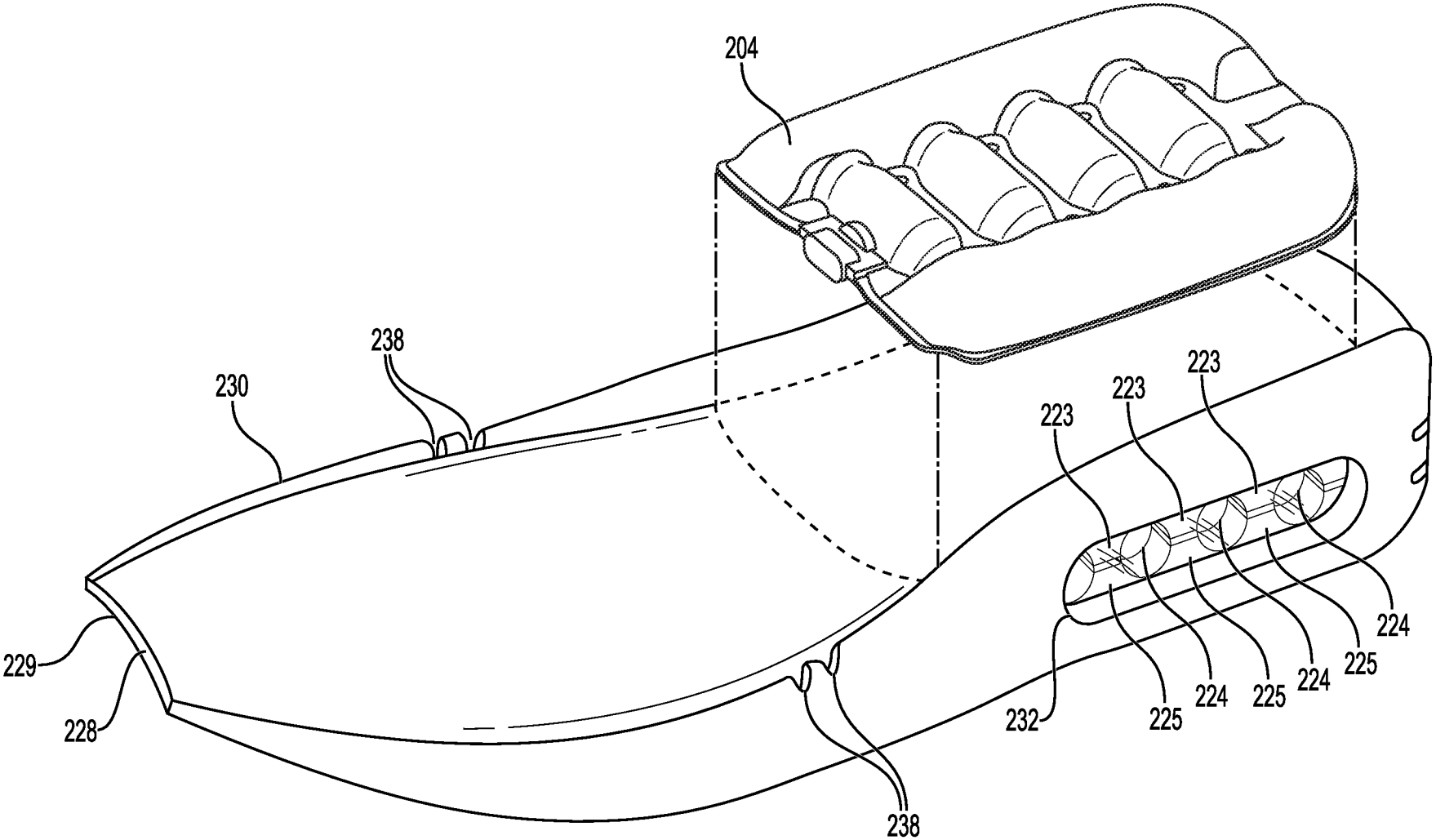
FIG. 3 is an exploded perspective view of the sole structure of the article of footwear of FIG. 1.

Referring to FIGS. 2 and 3, the top surface 246 may be a substantially smooth surface. Top surface 246 may extend continuously from the heel region 16 to the forefoot region 12. As top surface 246 extends from the heel region 16 to the forefoot region 12, top surface 246 may slope downwards in the mid-foot region 14 when viewed from an exterior of the midsole 202. On medial side 24 and lateral side 22, one or more sidewalls 230 may extend upward from the top surface 246.

The lateral face 245 of the midsole 202 may include a window 232. Window 232 may be defined by an absence of material and/or comprise a material having a transparent region. The entirety of window 232 may include the material comprising the transparent region. It is contemplated that window 232 may include a material comprising a translucent region. The entirety of window 232 may include the material comprising the translucent region. Window 232 may extend from a portion of the heel region 16 to a portion of the mid-foot region. Window 232 may have a height ranging from about 8 mm-to about 40 mm. Further, window 232 may have a height ranging from about 16 mm to about 20 mm. In an exemplary embodiment, the height of the window 232 is about 19 mm. While window 232 is transparent, window 232 may allow for a person viewing the exterior of the sole structure 102 to see through the material of window 232 to the interior of the sole structure 102. More particularly, when viewing through window 232, a person viewing from the exterior will see upper inner foam 223 and the lower inner foam 225. The viewer will see through the cushioning element 204 and out through the opposing window 232*a*.

Referring to FIG. 2, with description of the lateral side of the midsole 202, the one or more sidewalls 230 may extend from the heel region 16 to the forefoot region 12. The one or more sidewalls 230 may have a first region 232 present in the heel region 16. The first region 232 may rise towards an apex 234 in the heel region 16. The one or more sidewalls 230 may extend from the apex 234 towards a second region 236 present in the forefoot region 12. The one or more sidewalls 230 may slope downwards in the mid-foot region 14 when the one or more sidewalls 230 are extending from the apex 234 toward the second point 236, when viewed from an exterior of the midsole 202. The one or more sidewalls 230 may have disposed thereon a plurality of notches 238. The plurality of notches 238 may be disposed between the apex 234 and the second point 236. For example, notches 238 may be present on a portion of the one or more sidewalls 230 present in the mid-foot region 14. It is contemplated that the portion may be within an area of ball portion 12B disposed within the forefoot region 12.

The medial side of the midsole 202 may be substantially similar to the lateral side of the midsole 202. One or more sidewalls 230 may extend from the heel region 16 to the forefoot region 12. The one or more sidewalls 230 may have a first region present in the heel region 16. The first region may rise towards an apex in the heel region 16. The one or more sidewalls 230 may extend from the apex towards a second region present in the forefoot region 12. The one or more sidewalls 230 may slope downwards in the mid-foot region 14 when the one or more sidewalls 230 are extending from the apex toward the second point, when viewed from an exterior of the midsole 202. The one or more sidewalls 230 may have disposed thereon a plurality of notches 238. The plurality of notches 238 may be disposed between the apex and the second point. For example, notches 238 may be present on a portion of the one or more sidewalls 230 present in the mid-foot region 14. It is contemplated that the portion may be within an area of ball portion 12B disposed within the forefoot region 12.

With reference to FIG. 3, the interior cavity 224 may be present within an interior of the midsole 202. Interior cavity 224 may be defined by an upper inner foam 223 and a lower inner foam 225. Upper inner foam 223 and lower inner foam 225 may comprise one or more interior portions of midsole 202. Upper inner foam 223 may comprise an upper interior portion of midsole 202. Lower inner foam 225 may comprise a lower interior portion of midsole 202. Interior cavity 224 may further be defined by the windows 232 and 232*a*. Interior cavity 224 may be configured to enclose the cushioning element 204.

The forefoot portion 228 may be disposed in the forefoot region 12. The anterior most end 229 of the forefoot portion 228 may be curved radially inward towards the center of midsole 202. Alternatively, it is contemplated that the anterior most end 229 may curve radially outward.

Figure 5A:
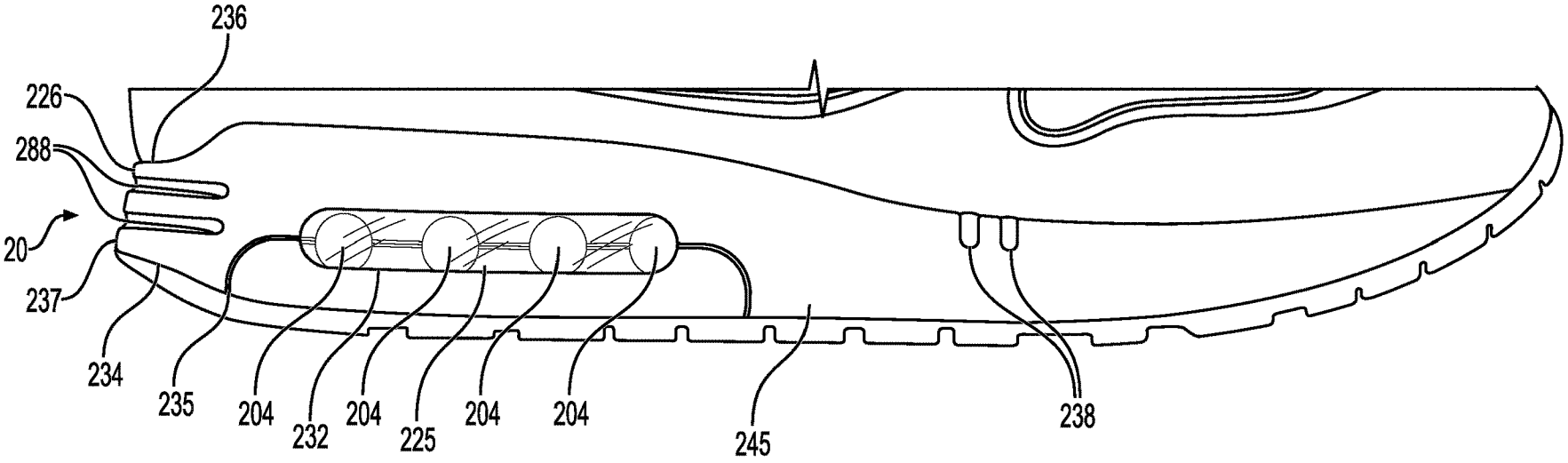
FIG. 5A is a partial view of the sole structure of FIG. 1.

Referring to FIG. 5A, the heel portion 226 may be disposed at a rearmost portion of the midsole 202 corresponding to the heel region 16 and the posterior end 20. A bottom surface 234 of the heel portion 226 may taper inward from a first point 235 present in the heel region 16 toward a second point 237 present at the posterior end 20. A top surface 236 of the heel portion 226 may be substantially flat when viewed from above. The top surface 236 may curve radially outward at its posterior most portion. The heel portion 226 have may have disposed thereon one or more slots 288. The one or more slots 288 may span an entire width of the heel portion 226 and may extend into a portion of the lateral face 245 and the medial face 247.

Cushioning Element

With reference to FIGS. 4A-4C and 5B, the cushioning element 204 of the midsole 202 may include an opposing pair of barrier films 242 and 244, which can be joined to each other at discrete locations to define a chamber 246, a web area 248 (divided into web areas 248*a*, 248*b*, 248*c*, 248*d*, and 248*e*), and a peripheral seam 250. Cushioning element 204 may be an airbag or a bladder.

Figure 4A:
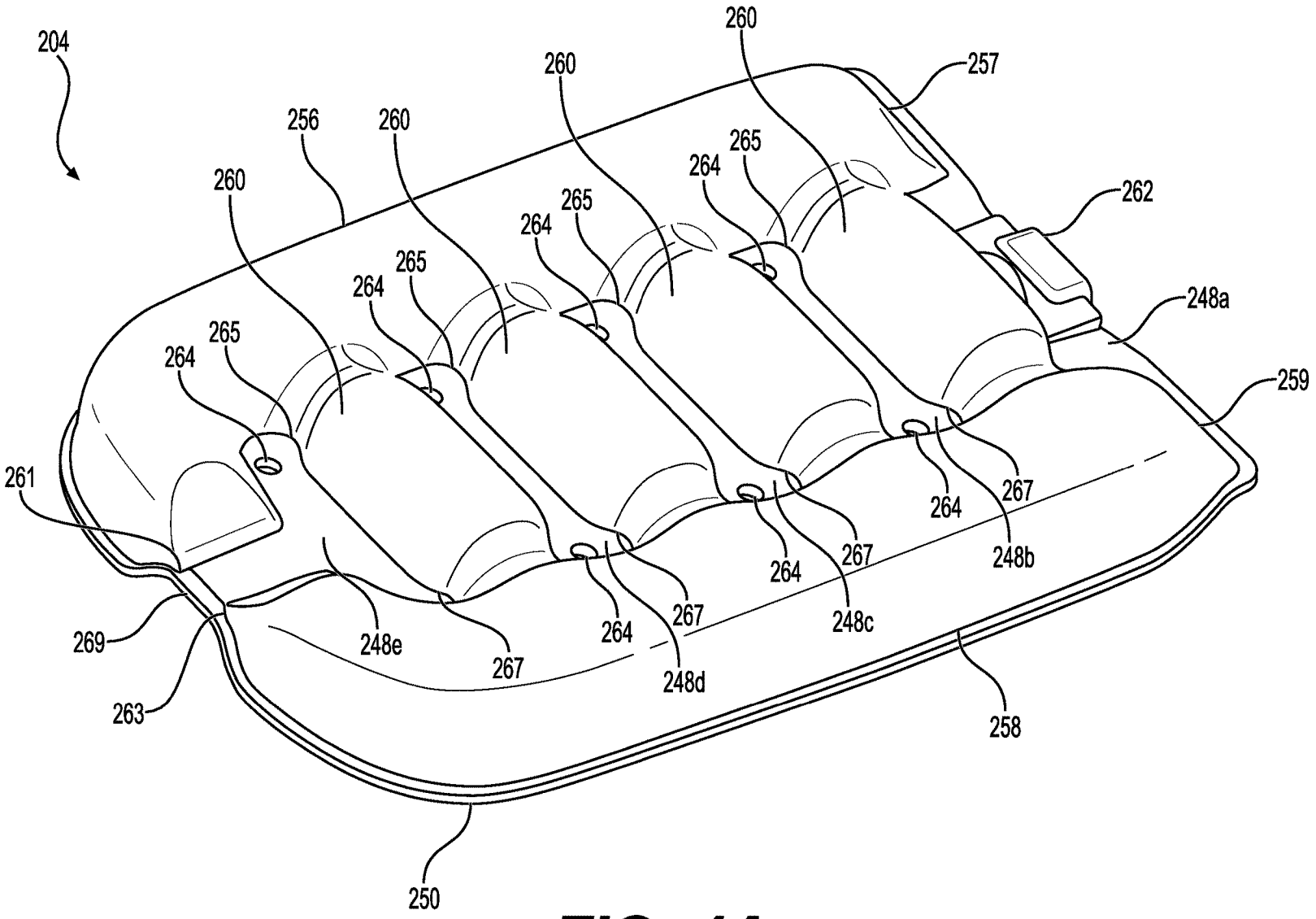
FIG. 4A is a perspective view of a cushioning element of the article of footwear of FIG. 1.
Figure 4B:
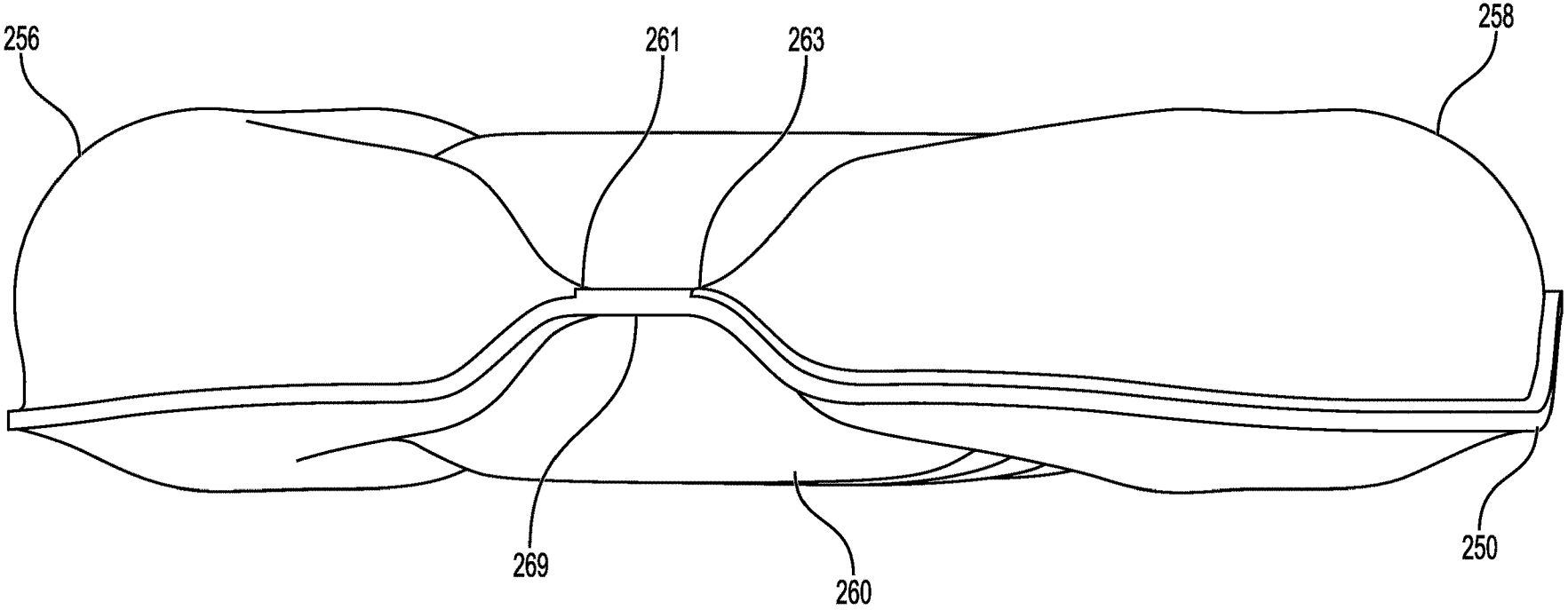
FIG. 4B is a rear view of the cushioning element of the article of footwear of FIG. 1.
Figure 4C:
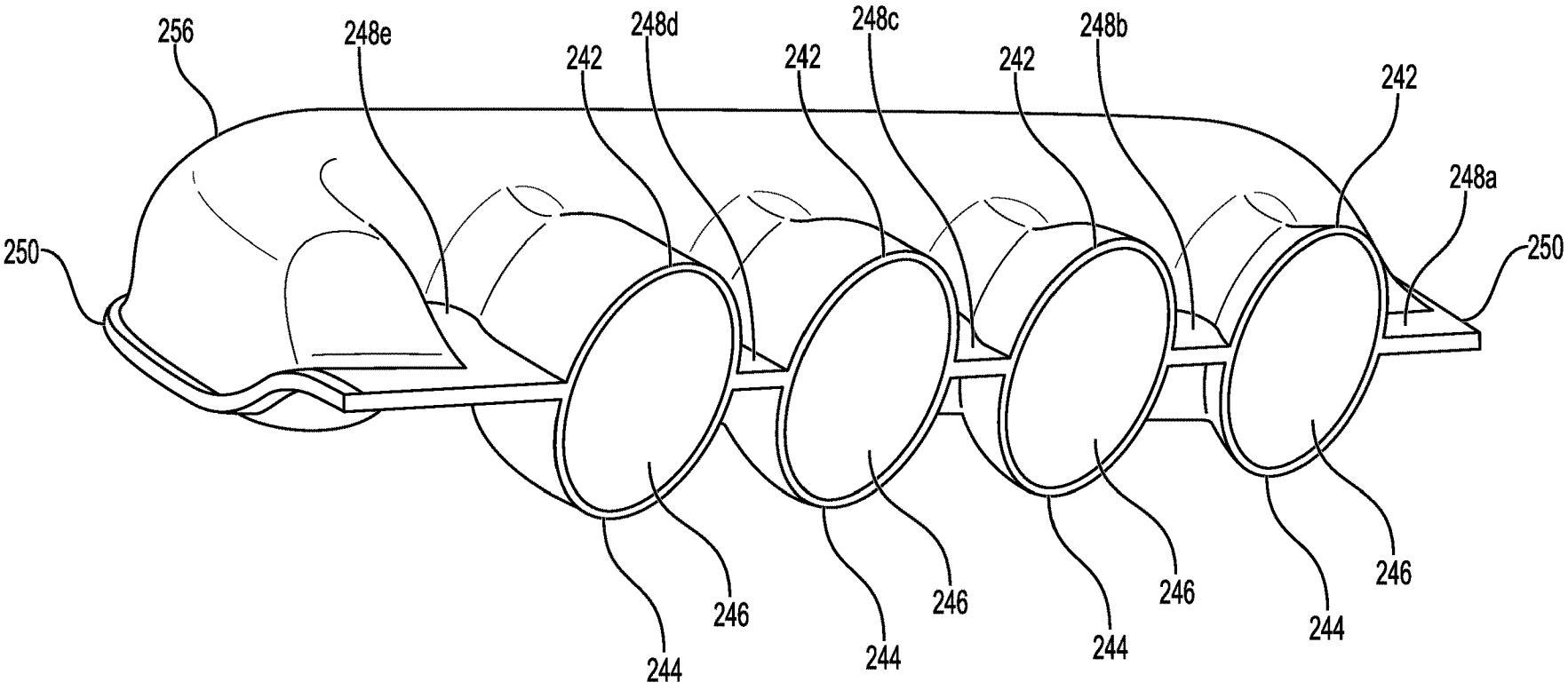
FIG. 4C is a cross-sectional view of the cushioning element of the article of footwear of FIG. 1.

Referring to FIG. 4C, the barrier films 242 and 244 may include a first, upper barrier film 242 and a second, lower barrier film 244. Alternatively, the chamber 246 can be produced from any suitable combination of one or more barrier films. Web area 248 may be an area where opposing barrier films 242 and 244 are bonded directly to one another without an intervening gap between the films.

As used herein, the term "barrier film" or "barrier membrane" (e.g., barrier films 242 and 244) encompasses both monolayer and multilayer films. In some embodiments, one or both of barrier films 242 and 244 may each be produced (e.g., thermoformed or blow molded) from a monolayer film (a single layer). In other embodiments, one or both of barrier films 242 and 244 may each be produced (e.g., thermoformed or blow molded) from a multilayer film (multiple sublayers). The multi-layered film may comprise a plurality of layers. The plurality of layers may comprise one or more barrier layers. The one or more barrier layers may comprise a barrier material. The barrier material may comprise or consist essentially of one or more gas barrier compounds. The multi-layered film may comprise at least 5 layers or at least 10 layers. In other embodiments, the multi-layered film may comprise from about 5 layers to about 400 layers. In one aspect of a multi-layered film, the plurality of layers may include a series of alternating layers, in which the alternating layers include two or more barrier layers. Each of the two or more barrier layers may individually comprise a barrier material, the barrier material comprising or consisting essentially of one or more gas barrier compounds. In the series of alternating layers, adjacent layers may be individually formed of materials which differ from each other at least in their chemical compositions based on the individual components present (e.g., the materials of adjacent layers may differ based on whether or not a gas barrier compound is present, or differ based on class or type of gas barrier compound present), the concentration of the individual components present (e.g., the materials of adjacent layers may differ based on the concentration of a specific type of gas barrier compound present), or may differ based on both the components present and their concentrations.

The plurality of layers of the multi-layered film may include first barrier layers comprising a first barrier material and second barrier layers comprising a second barrier material, wherein the first and second barrier materials differ from each other as described above. The first barrier material may be described as comprising a first gas barrier component consisting of all the gas barrier compounds present in the first barrier material, and the second barrier material may be described as comprising a second barrier material component consisting of all the gas barrier compounds present in the second barrier material. In a first example, the first barrier component may consist only of one or more gas barrier polymers, and the second barrier component may consist only of one or more inorganic gas barrier compounds. In a second example, the first barrier component may consist of a first one or more gas barrier polymers, and the second component may consist of a second one or more gas barrier polymers, wherein the first one or more gas barrier polymers differ from the second one or more gas barrier polymers in polymer class, type, or concentration. In a third example, the first barrier component and the second barrier component both may include the same type of gas barrier compound, but the concentration of the gas barrier compound may differ. Optionally the concentrations may differ by at least 5 weight percent based on the weight of the barrier material. In these multi-layered films, the first barrier layers and the second barrier layers may alternate with each other, or may alternate with additional barrier layers (e.g., third barrier layers comprising a third barrier material, fourth barrier layers comprising a fourth barrier material, etc., wherein each of the first, second, third and fourth, etc., barrier materials differ from each other as described above).

In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers. In yet further embodiments, the film thickness for each layer or sublayer can range from about 72 micrometers to about 320 micrometers.

The lower barrier film 244 may have a greater thickness than the upper barrier film 242, or vice versa. When thicker than the upper barrier film 242, the lower barrier film 244 may be configured to provide a portion of the ground-contacting surface of the article of footwear 10. Alternatively, the lower barrier film 244 and upper barrier film 242 may have equal thicknesses.

One or both of barrier films 242 and 244 may independently be transparent, translucent, and/or opaque. For example, the upper barrier film 242 may be transparent, while the lower barrier film 244 is opaque. It is contemplated that upper barrier film 242 may be transparent or translucent, while lower barrier film 244 is opaque, or upper barrier film 242 may be opaque, while lower barrier film 244 is transparent or translucent, etc. As used herein, the term "transparent" for a barrier film and/or a fluid-filled chamber means that light passes through the barrier film in substantially straight lines and a viewer can see through the barrier film. In comparison, for an opaque barrier film, light does not pass through the barrier film and one cannot see clearly through the barrier film at all. A translucent barrier film falls between a transparent barrier film and an opaque barrier film, in that light passes through a translucent film but some of the light is scattered so that a viewer cannot see clearly through the .film.

The chamber 246 may be produced from barrier films 242 and 244 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier films 242 and 244 may be produced by co-extrusion followed by vacuum thermoforming to produce an inflatable chamber 246, which may optionally include one or more valves (e.g., one way valves) that allows the chamber 246 to be filled with a fluid (e.g., gas).

The chamber 246 may be provided in a fluid-filled (e.g., as provided in footwear 10) or in an unfilled state. The chamber 246 may be filled to include any suitable fluid, such as a gas or liquid. In an aspect, the gas can include air, nitrogen ($N_2$), oxygen gases ($O_2$), inert gases, or any other suitable gas. In other aspects, the chamber 246 may alternatively include other media, such as pellets, beads, ground recycled material, and the like (e.g., foamed beads and/or rubber beads). The chamber 246 may be a membrane having a relatively low rate of transmittance of a fluid. When used alone or in combination with other materials in an airbag or bladder, the barrier membrane resiliently retains the fluid. Depending upon the structure and use of the airbag or bladder, the barrier membrane may retain the fluid at a pressure which is above, at, or below atmospheric pressure. The fluid provided to the chamber 246 may result in the chamber 246 being pressurized. The chamber 246 may have a pressure ranging from about atmospheric pressure to about 40 PSI. The chamber 246 may have a pressure ranging from about 10 PSI to about 25 PSI. The chamber 246 may have a pressure ranging from about 12 PSI to about 25 PSI. In an exemplary embodiment, the chamber 246 may have a pressure of about 15 PSI. It is contemplated that the chamber 246 may be pressurized to a pressure for desired characteristics of cushioning. Alternatively, the fluid provided to the chamber 246 may be at atmospheric pressure such that the chamber 246 is not pressurized but, rather, simply contains a volume of fluid at atmospheric pressure.

The chamber 246 desirably may have a low gas transmission rate to preserve its retained gas pressure. In some embodiments, the chamber 246 may have a gas transmission rate for nitrogen gas that is at least about ten (10) times lower than a nitrogen gas transmission rate for a butyl rubber layer of substantially the same dimensions. In an aspect, the chamber 246 may have a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier films 242 and 244). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the upper barrier film 242 and the lower barrier film 244 may cooperate to define a geometry (e.g., thicknesses, width, and lengths) of the chamber 246. For example, the web area 248 and the peripheral seam 250 may cooperate to bound and extend around the chamber 246 to seal the fluid (e.g., air) within the chamber 246. Thus, the chamber 246 is associated with an area of the cushioning element 204 where interior surfaces of the upper and lower barrier films 242 and 244 are not joined together and, thus, are separated from one another. As shown in FIG. 4C, a space formed between opposing interior surfaces of the upper and lower barrier films 242 and 244 defines an interior void of the chamber 246. Similarly, exterior surfaces of the upper and lower barrier films 242 and 244 define an exterior profile of the chamber 246. Accordingly, the upper and lower barrier films 242 and 244 define respective upper and lower surfaces of the cushioning element 204.

Referring to FIGS. 4A and 4B, the cushioning element 204 may include a medial tubular body 256, a lateral tubular body 258, one or more central tubular bodies 260, and a valve 262.

Medial tubular body 256 and lateral tubular body 258 may be disposed on the respective medial side 24 and lateral side 22. Medial tubular body 256 may extend from a medial first end 257 to a medial second end 261. Lateral tubular body 258 may extend from a lateral first end 259 to a lateral second end 263. Medial tubular body 256 may have a "J"-shape. Lateral tubular body 258 also may have a "J"-shape. Medial tubular body 256 and lateral tubular body 258 may be substantial mirrors of one another. The medial tubular body 256 may taper inward when approaching medial second end 261. The lateral tubular body 258 may taper inward when approaching lateral second end 263. The web areas 248*a*, 248*b*, 248*c*, 248*d*, and 248*e* may be disposed between the medial tubular body 256 and the lateral tubular body 258. The taper between the medial second end 261 and lateral second end 263, the web area 248*e*, and the peripheral seam 250 may form a pinch 269 in the heel most region of the cushioning element 240. Pinch 269 may be substantially X-shaped when viewed from an exterior and on the side of the cushioning element 240.

The peripheral seam 250 may be disposed on a bottom surface of cushioning element 204. Specifically, peripheral seam 250 may be disposed on a bottom surface of medial tubular body 256 and lateral tubular body 258. A portion of peripheral seam 250 forming the pinch 269 may rise from the bottom surface of the medial tubular body 256 toward the medial second end 261. A second portion of peripheral seam 250 forming the pinch 269 may rise from the bottom surface of the lateral tubular body 258 toward the lateral second end 263. Peripheral seam 250 may not be visible through windows 232 and 232*a*.

The one or more central tubular bodies 260 may extend along a length of the cushioning element 240. The one or more central tubular bodies 260 may span a width of the cushioning element 240 extending between the medial tubular body 256 and the lateral tubular body 258. The one or more central tubular bodies 260 may taper radially inward at a medial end 265 as the one or more central tubular bodies 260 approach the medial tubular body 256. In other words, the medial end 265 may form a reduced diameter section. The reduced diameter section comprises a diameter of the medial end 265 being less than a diameter of a portion of the medial tubular body 256. Additionally, the one or more central tubular bodies 260 may taper inward at a lateral end 267 as the one or more central tubular bodies 260 approach the lateral tubular body 258. In other words, the lateral end 267 may form a reduced diameter section. The reduced diameter section comprises a diameter of the lateral end 267 being less than a diameter of a portion of the medial tubular body 258. The web areas 248*b*, 248*c*, and 248*d*, may be disposed between the one or more central tubular bodies 260. The one or more central tubular bodies 260 may be in fluid communication with the medial tubular body 256 and the lateral tubular body 258. The web area 248 may have disposed therein one or more pairs of holes 264. The one or more pairs of holes 264 may be disposed at respective medial and lateral ends of the web area 248 corresponding to the medial and lateral ends 265 and 267, respectively.

Valve 262 may be present at the forefoot most area of the cushioning element 240 or any other suitable location for providing fluid to the cushioning element 204. Valve 262 may be in fluid communication with the one or more central tubes 260. The valve 262 may be configured to provide a fluid passage between a mold cavity (not shown) and the interior of the chamber 246.

With reference to FIGS. 4A-4C, the web area 248 may formed at a bonded region of the upper barrier film 242 and the lower barrier film 244, and may extend between and connect each of the medial tubular body 256, the lateral tubular body 258, and the one or more central tubular bodies 260.

Outsole

With reference to FIG. 6, outsole 206 may extend from the anterior end 18 to the posterior end 20. Outsole 206 may have disposed thereon a plurality of traction elements 602*a*, 602*b*, 602*c*, and 602*d*. Outsole 206 may comprise a plurality of traction zones 604, 606, 608, and 610. Outsole 206 may further include one or more separators 612. Separators 216 may be grooves in the outsole 206. Alternatively, it is contemplated that separators 216 may be protrusions or the like extending from outsole 206 as necessary for dividing the outsole into multiple areas of traction for the article of footwear 10. In an exemplary embodiment, separators 612 may be subdivided into separators 612*a*, 612*b*, and 612*c*. It is contemplated that there may be one, two, three, or more separators as necessary to provide separation for various traction zones.

Traction zone 604 may be disposed at the anterior end 18. Traction zone 606 may be disposed adjacent to traction zone 604 and traction zone 608. Traction zone 606 may be separated from traction zone 604 by separator 612*a*. Traction zone 606 may be separated from traction zone 608 by separator 612*b*. In other words, traction zone 606 may be bound at its top surface by traction zone 604 as well as separator 612*a*, and traction zone 606 may be bound at its bottom surface by traction zone 608 as well as separator 612*b*. Traction zone 608 may be disposed adjacent to traction zone 606 and traction zone 610. Traction zone 608 may be separated from traction zone 606 by separator 612*b*. Traction zone 608 may be separated from traction zone 610 by separator 612*c*. In other words, traction zone 608 may be bound at its top surface by traction zone 606 as well as separator 612*b*, and traction zone 608 may be bound at its bottom surface by traction zone 610 as well as separator 612*c*. Traction zone 610 may be disposed adjacent to traction zone 608, and separated by separator 612*c*. Traction zone 610 may be disposed at the posterior end 20. Traction zone 604 may not be disposed adjacent to either of traction zones 608 and 610. Traction zone 606 may not be disposed adjacent to traction zone 610. Traction zone 608 may not be disposed adjacent to transaction zone 604. Traction zone 610 may not be disposed adjacent to either of traction zones 604 and 606.

Each of the traction zones 604, 606, 608, and 610 may include the corresponding plurality of traction elements 602*a*, 602*b*, 602*c*, and 602*d*. The plurality of traction elements 602 may have a shape that is substantially square or rectangular. It is contemplated that the plurality of traction elements 602 may have a shape that is triangular, diamond, ovular, or irregular to provide a desired form of traction.

The outsole 206 may be formed of materials, e.g., resilient materials among others, configured to impart properties of abrasion resistance and traction to the sole structure 102. One or more of the outsole 102 and traction elements 602 may be formed of a first material having a higher durometer than the other.

Alternatively, the outsole 102 and the traction elements 602 may include the same material. The outsole 206 and the traction elements 602 may form the ground-engaging surface of the article of footwear 10.

The material of the outsole 206 can be a resilient material as described below. In one aspect, the resilient material is an elastomeric material comprising or consisting essentially of one or more elastomers. Examples of elastomers include butyl rubber, isoprene rubber, nitrile rubber, styrenic block copolymer rubber such as styrene-butadiene rubber, polyolefin rubber such as ethylene propylene rubber, silicone rubber, and combinations thereof. In some aspects, the one or more elastomers comprise thermoset elastomers. In other aspects, the one or more elastomers comprise thermoplastic elastomers. Examples of thermoplastic elastomers include thermoplastic styrenic block copolymer rubber, thermoplastic vulcanizate rubber, thermoplastic polyolefin rubber, thermoplastic polyurethane rubber, and combinations thereof. In addition to the one or more elastomers, the elastomeric material optionally can comprise one or more non-polymeric compounds, including fillers, processing aids, colorants, and combinations thereof.

Assembled Sole Structure

Figure 5B:
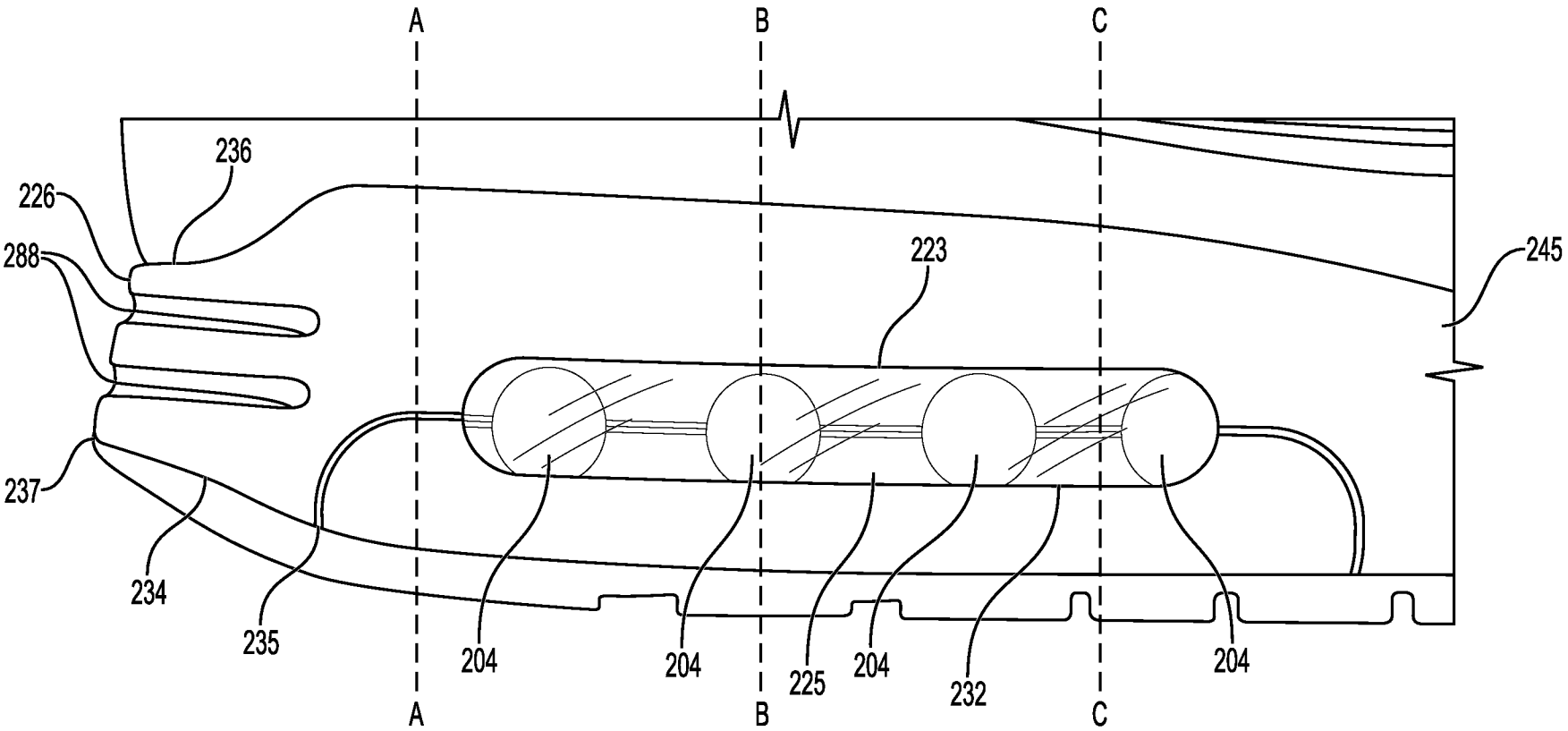
FIG. 5B is a zoomed in partial view of the sole structure of FIG. 1.

With reference to FIGS. 5A and 5B, the cushioning element 240 may be configured to cooperate with the internal cavity 224 of the midsole 202. The cushioning element 240 may be disposed between the upper inner foam 223 and lower inner foam 225. The upper and lower inner foams 223 and 225 may be in communication with the web area 248 of the cushioning element 240 thereby allowing the upper and lower inner foams 223 and 225 to surround the cushioning element 240. Specifically, chamber 246 of the cushioning element 240 may be surrounded by the upper and lower inner foams 223 and 225 such that a viewer of the sole structure 102 would be able to see the environment on the opposite side due to the transparency of windows 232 and 232*a* as well as barrier films 242 and 244 of the cushioning element 204.

When viewing the exterior of the footwear 10 from the ground up, the sole structure 102 may include the outsole 206, the midsole 202, and the cushioning element 204.

Referring to FIG. 5B, when viewing the stacked sole structure from the ground up along the exterior path of line A, the stacked sole structure may include the outsole 206 and the midsole 202. When viewed along the exterior path of line B, the stacked sole structure may include the outsole 206, the window 232, cushioning element 204, the chamber 246, the upper and lower inner foams 223 and 225, and the midsole 202. The cushioning element 204, the chamber 246, and the upper and lower inner foams 223 and 225 are only visible through the window 232. When viewed along the exterior path of line C, the stacked sole structure may include the outsole 206, the window 232, cushioning element 204, web area 248, the upper and lower inner foams 223 and 225, and the midsole 202. The cushioning element 204, web area 248, and the upper and lower inner foams 223 and 225 are only visible through the window 232.

Manufacturing Process

In some implementations, the upper and lower barrier films 242 and 244 may be formed by respective mold portions. The respective mold portions may each define various surfaces for forming depressions and pinched surfaces corresponding to locations where the web area 248 and/or the peripheral seam 250 are formed when the upper barrier film 242 and the lower barrier film 244 are joined and bonded together. In some implementations, adhesive bonding may join the upper barrier film 242 and the lower barrier film 244 to form the web area 248 and the peripheral seam 250. In other implementations, the upper barrier film 242 and the lower barrier film 244 may be joined to form the web area 248 and the peripheral seam 250 by thermal bonding. In some examples, one or both of the barrier films 242 and 244 may be heated to a temperature that facilitates shaping and melding. In some examples, the barrier films 242 and 244 may be heated prior to being located between their respective molds. In other examples, the mold may be heated to raise the temperature of the barrier films 242 and 244. In some implementations, a molding process used to form the fluid-filled chamber 246 may incorporate vacuum ports within mold portions to remove air such that the upper and lower barrier films 242 and 244 are drawn into contact with respective mold portions. In other implementations, fluids such as air may be injected into areas between the upper and lower barrier films 242 and 244 such that pressure increases cause the barrier films 242 and 244 to engage with surfaces of their respective mold portions.

The multi-layered films may be produced by various means such as co-extrusion, lamination, layer-by-layer deposition, and the like. When co-extruding one or more barrier layers alone or with one or more second layers, selecting materials (e.g., a first barrier material and a second barrier material, or a single barrier material and a second material) having similar processing characteristics such as melt temperature and melt flow index, may reduce interlayer shear during the extrusion process, and may allow the alternating barrier layers and second layers to be co-extruded while retaining their structural integrities and desired layer thicknesses. In one example, the one or more barrier materials and optionally the second material when used, may be extruded into separate individual films, which may then be laminated together to form the multi-layered films.

The multi-layered films may be produced using a layer-by-layer deposition process. A substrate, which optionally may comprise a second material or a barrier material, may be built into a multi-layered film by depositing a plurality of layers onto the substrate. The layers may include one or more barrier layers (e.g., first barrier layers, second barrier layers, etc.). Optionally, the layers may include one or more second layers. The one or more barrier layers and/or second layers may be deposited by any means known in the art such as, for example, dipping, spraying, coating, or another method. The one or more barrier layers may be applied using charged solutions or suspensions, e.g., cationic solutions or suspensions or anionic solutions or suspensions, including a charged polymer solution or suspension. The one or more barrier layers may be applied using a series of two or more solutions having opposite charges, e.g., by applying a cationic solution, followed by an anionic solution, followed by a cationic solution, followed by an anionic solution, etc.

The barrier membranes, including the multi-layered films, have an overall thickness of from about 40 micrometers to about 500 micrometers, or about 50 micrometers to about 400 micrometers, or about 60 micrometers to about 350 micrometers. In one aspect, each individual layer of the plurality of layers of the multi-layered film has a thickness of from about 0.001 micrometers to about 10 micrometers. For example, the thickness of an individual barrier layer can range from about 0.001 micrometers to about 3 micrometers thick, or from about 0.5 micrometers to about 2 micrometers thick, or from about 0.5 micrometers to about 1 micrometer thick. The thickness of an individual second layer may range from about 2 micrometers to about 8 micrometers thick, or from about 2 micrometers to about 4 micrometers thick.

In a further aspect, thickness of the films and/or their individual layers may be measured by any method known in the art such as, for example, ASTM E252, ASTM D6988, ASTM D8136, or using light microscopy or electron microscopy.

In some aspects, the barrier membranes, including the multi-layered films, may have a Shore hardness of from about 35A to about 95A, optionally from about 55A to about 90A. In these aspects, hardness may be measured using ASTM D2240 using the Shore A scale.

In one aspect, when a co-extrusion process is used to form the barrier membrane from a plurality of alternating barrier layers and second layers, the barrier material may have a melt flow index of from about 5 to about 7 grams per 10 minutes at 190 degrees Celsius when using a weight of 2.16 kilograms, while the second material may have a melt flow index of from about 20 to about 30 grams per 10 minutes at 190 degrees Celsius when using a weight of 2.16 kilograms. In a further aspect, the melt flow index of the barrier material may be from about 80 percent to about 120 percent of the melt flow index of the barrier material per 10 minutes when measured at 190 degrees Celsius when using a weight of 2.16 kilograms. In these aspects, melt flow index may be measured using ASTM D1238. Alternatively or additionally, the barrier material or the second material or both may have a melting temperature of from about 165 degrees Celsius to about 183 degrees Celsius, or from about 155 degrees Celsius to about 165 degrees Celsius. In one such example, the barrier material may have a melting temperature of from about 165 degrees Celsius to about 183 degrees Celsius, while the second material has a melting temperature of from about 155 degrees Celsius to about 165 degrees Celsius. Further in these aspects, melting temperature can be measured using ASTM D3418.

Materials

Barrier films 242 and 244 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier films 242 and 244 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier films 242 and 244 include two or more sublayers, examples of suitable multilayer films include microlayer films, such as those disclosed in Bonk et al., U.S. Pat. No. 6,582,786, which is incorporated by reference in its entirety. In further embodiments, barrier films 242 and 244 may each independently include alternating sublayers of one or more TPU copolymer materials and one or more EVOH copolymer materials, where the total number of sublayers in each of barrier films 242 and 244 includes at least four (4) sublayers, at least ten (10) sublayers, at least twenty (20) sublayers, at least forty (40) sublayers, and/or at least sixty (60) sublayers.

In one aspect, the barrier material may comprise or consist essentially of one or more inorganic gas barrier compounds. The one or more inorganic gas barrier compounds can take the form of fibers, particulates, platelets, or combinations thereof. The fibers, particulates, platelets may comprise or consist essentially of nanoscale fibers, particulates, platelets, or combinations thereof. Examples of inorganic barrier compounds includes, for example, carbon fibers, glass fibers, glass flakes, silicas, silicates, calcium carbonate, clay, mica, talc, carbon black, particulate graphite, metallic flakes, and combinations thereof. The inorganic gas barrier component may comprise or consist essentially of one or more clays. Examples of suitable clays include bentonite, montmorillonite, kaolinite, and mixtures thereof. In one example, the inorganic gas barrier component consists of clay. Optionally, the barrier material may further comprise one or more additional ingredients, such as a polymer, processing aid, colorant, or any combination thereof. In aspects where the barrier material comprises or consists essentially of one or more inorganic barrier compounds, the barrier material may be described as comprising an inorganic gas barrier component consisting of all inorganic barrier compounds present in the barrier material. When one or more inorganic gas barrier compounds are included in the barrier material, the total concentration of the inorganic gas barrier component present in the barrier material may be less than 60 weight percent, or less than 40 weight percent, or less than 20 weight percent of the total composition. Alternatively, in other examples, the barrier material may consist essentially of the one or more inorganic gas barrier materials.

In one aspect, the gas barrier compound comprises or consists essentially of one or more gas barrier polymers. The one or more gas barrier polymers can include thermoplastic polymers. In one example, the barrier material can comprise or consist essentially of one or more thermoplastic polymers, meaning that the barrier material comprises or consists essentially of a plurality of thermoplastic polymers, including thermoplastic polymers which are not gas barrier polymers. In another example, the barrier material comprises or consists essentially of one or more thermoplastic gas barrier polymers, meaning that all the polymers present in the barrier material are thermoplastic gas barrier polymers. The barrier material may be described as comprising a polymeric component consisting of all polymers present in the barrier material. For example, the polymeric component of the barrier material may consist of a single class of gas barrier polymer, such as, for example, one or more polyolefin, or can consist of a single type of gas barrier polymer, such as one or more ethylene-vinyl alcohol copolymers. Optionally, the barrier material may further comprise one or more non-polymeric additives, such as one or more filler, processing aid, colorant, or combination thereof.

Many gas barrier polymers are known in the art. Examples of gas barrier polymers include vinyl polymers such as vinylidene chloride polymers, acrylic polymers such as acrylonitrile polymers, polyamides, epoxy polymers, amine polymers, polyolefins such as polyethylenes and polypropylenes, copolymers thereof, such as ethylene-vinyl alcohol copolymers, and mixtures thereof. Examples of thermoplastic gas barrier polymers include thermoplastic vinyl homopolymers and copolymers, thermoplastic acrylic homopolymers and copolymers, thermoplastic amine homopolymers and copolymers, thermoplastic polyolefin homopolymers and copolymers, and mixtures thereof. In one example, the one or more gas barrier polymers comprise or consist essentially of one or more thermoplastic polyethylene copolymers, such as, for example, one or more thermoplastic ethylene-vinyl alcohol copolymers. The one or more ethylene-vinyl alcohol copolymers can include from about 28 mole percent to about 44 mole percent ethylene content, or from about 32 mole percent to about 44 mole percent ethylene content. In yet another example, the one or more gas barrier polymers can comprise or consist essentially of one or more one or more polyethyleneimine, polyacrylic acid, polyethyleneoxide, polyacrylamide, polyamidoamine, or any combination thereof.

The second material of the one or more second layers can comprise one or more polymers. Depending upon the class of gas barrier compounds used and the intended use of the multi-layered film, the second material may have a higher gas transmittance rate than the barrier material, meaning that the second material is a poorer gas barrier than the barrier material. In some aspects, the one or more second layers may act as substrates for the one or more barrier layers, and may serve to increase the strength, elasticity, and/or durability of the multi-layered film. Alternatively or additionally, the one or more second layers may serve to decrease the amount of gas barrier material(s) needed, thereby reducing the overall material cost. Even when the second material has a relatively high gas transmittance rate, the presence of the one or more second layers, particularly when the one or more second layers are positioned between one or more barrier layers, may help maintain the overall barrier properties of the film by increasing the distance between cracks in the barrier layers, thereby increasing the distance gas molecules must travel between cracks in the barrier layers in order to pass through the multi-layered film. While small fractures or cracks in the barrier layers of a multi-layered film may not significantly impact the overall barrier properties of the film, using a larger number of thinner barrier layers can avoid or reduce visible cracking, crazing or hazing of the multi-layered film. The one or more second layers can include, but are not limited to, tie layers adhering two or more layers together, structural layers providing mechanical support to the multi-layered films, bonding layers providing a bonding material such as a hot melt adhesive material to the multi-layered film, and/or cap layers providing protection to an exterior surface of the multi-layered film.

In some aspects, the second material is an elastomeric material comprising or consisting essentially of at least one elastomer. Many gas barrier compounds are brittle and/or relatively inflexible, and so the one or more barrier layers may be susceptible to cracking when subjected to repeated, excessive stress loads, such as those potentially generated during flexing and release of a multi-layered film. A multi-layered film which includes one or more barrier layers alternating with second layers of an elastomeric material results in a multi-layered film that is better able to withstand repeated flexing and release while maintaining its gas barrier properties, as compared to a film without the elastomeric second layers present.

The second material comprises or consists essentially of one or more polymers. As used herein, the one or more polymers present in the second material are referred to herein as one or more "second polymers" or a "second polymer", as these polymers are present in the second material. References to "second polymer(s)" are not intended to indicate that a "first polymer" is present, either in the second material, or in the multi-layered film as a whole, although, in many aspects, multiple classes or types of polymers are present. In one aspect, the second material comprises or consists essentially of one or more thermoplastic polymers. In another aspect, the second material comprises or consists essentially of one or more elastomeric polymers. In yet another aspect, the second material comprises or consists essentially of one or more thermoplastic elastomers. The second material can be described as comprising a polymeric component consisting of all polymers present in the second material. In one example, the polymeric component of the second material consists of one or more elastomers. Optionally, the second material can further comprise one or more non-polymeric additives, such as fillers, processing aids, and/or colorants.

Many polymers which are suitable for use in the second material are known in the art. Exemplary polymers which can be included in the second material (e.g., second polymers) include polyolefins, polyamides, polycarbonates, polyimines, polyesters, polyacrylates, polyesters, polyethers, polystyrenes, polyureas, and polyurethanes, including homopolymers and copolymers thereof (e.g., polyolefin homopolymers, polyolefin copolymers, etc.), and combinations thereof. In one example, the second material comprises or consists essentially of one or more polymers chosen from polyolefins, polyamides, polyesters, polystyrenes, and polyurethanes, including homopolymers and copolymers thereof, and combinations thereof. In another example, the polymeric component of the second material consists of one or more thermoplastic polymers, or one or more elastomers or one or more thermoplastic elastomers, including thermoplastic vulcanizates. Alternatively, the one or more second polymers can include one or more thermoset or thermosettable elastomers, such as, for example, natural rubbers and synthetic rubbers, including butadiene rubber, isoprene rubber, silicone rubber, and the like.

Polyolefins are a class of polymers which include monomeric units derived from simple alkenes, such as ethylene, propylene and butene. Examples of thermoplastic polyolefins include polyethylene homopolymers, polypropylene homopolymers polypropylene copolymers (including polyethylene-polypropylene copolymers), polybutene, ethylene-octene copolymers, olefin block copolymers; propylene-butane copolymers, and combinations thereof, including blends of polyethylene homopolymers and polypropylene homopolymers. Examples of polyolefin elastomers include polyisobutylene elastomers, poly(alpha-olefin) elastomers, ethylene propylene elastomers, ethylene propylene diene monomer elastomers, and combinations thereof.

Polyamides are a class of polymers which include monomeric units linked by amide bonds. Naturally-occurring polyamides include proteins such as wool and silk, and synthetic amides such as nylons and aramids. The one or more second polymers can include thermoplastic polyamides such as nylon 6, nylon 6-6, nylon-11, as well as thermoplastic polyamide copolymers.

Polyesters are a class of polymers which include monomeric units derived from an ester functional group, and are commonly made by condensing dibasic acids such as, for example, terephthalic acid, with one or more polyols. In one example, the second material can comprise or consist essentially of one or more thermoplastic polyester elastomers. Examples of polyester polymers include homopolymers such as polyethylene terephthalate, polybutylene terephthalate, poly-1,4-cyclohexylene-dimethylene terephthalate, as well as copolymers such as polyester polyurethanes.

Styrenic polymers are a class of polymers which include monomeric units derived from styrene. The one or more second polymers can comprise or consist essentially of styrenic homopolymers, styrenic random copolymers, styrenic block copolymers, or combinations thereof. Examples of styrenic polymers include styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

Polyurethanes are a class of polymers which include monomeric units joined by carbamate linkages. Polyurethanes are most commonly formed by reacting a polyisocyanate (e.g., a diisocyanate or a triisocyanate) with a polyol (e.g., a diol or triol), optionally in the presence of a chain extender. The monomeric units derived from the polyisocyanate are often referred to as the hard segments of the polyurethane, while the monomeric units derived from the polyols are often referred to as the soft segments of the polyurethane. The hard segments can be derived from aliphatic polyisocyanates, or from organic isocyanates, or from a mixture of both. The soft segments can be derived from saturated polyols, or from unsaturated polyols such as polydiene polyols, or from a mixture of both. When the multilayered film is to be bonded to natural or synthetic rubber, including soft segments derived from one or more polydiene polyols can facilitate bonding between the rubber and the film when the rubber and the film are crosslinked in contact with each other, such as in a vulcanization process.

Examples of suitable polyisocyanates from which the hard segments of the polyurethane can be derived include hexamethylene diisocyanate (HDI), isophorone diisocyanate (IPDI), butylenediisocyanate (BDI), bisisocyanatocyclohexylmethane (HMDI), 2,2,4-trimethylhexamethylene diisocyanate (TMDI), bisisocyanatomethylcyclohexane, bisisochanatomethyltricyclodecane, norbornane diisocyanate (NDI), cyclohexane diisocyanate (CHDI), 4,4'-dicyclohexylmethane diisocyanate (H12MDI), diisocyanatododecane, lysine diisocyanate, toluene diisocyanate (TDI), TDI adducts with trimethylolpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and any combination thereof. In one aspect, the polyurethane comprises or consists essentially of hard segments derived from toluene diisocyanate (TDI), or from methylene diphenyl diisocyanate (MDI), or from both.

The soft segments of the polyurethane can be derived from a wide variety of polyols, including polyester polyols, polyether polyols, polyester-ether polyols, polycarbonate polyols, polycaprolactone polyethers, and combinations thereof. In one aspect, the polyurethane comprises or consist essentially of monmeric units derived from C4-C12 polyols, or C6-C10 polyols, or C8 or lower polyols, meaning polyols with 4 to 12 carbon molecules, or with 6 to 10 carbon molecules, or with 8 or fewer carbon molecules in their chemical structures. In another aspect, the polyurethane comprises or consists essentially of monomeric units derived from polyester polyols, polyester-ether polyols, polyether polyols, and any combination thereof. In yet another aspect, the polyurethane comprises or consists essentially of soft segments derived from polyols or diols having polyester functional units. The soft segments derived from polyols or diols having polyester functional units can comprise about 10 to about 50, or about 20 to about 40, or about 30 weight percent of the soft segments present in the polyurethane.

In an alternative embodiment, instead of being a fluid-filled bladder, the cushioning element 204 comprises a material, such as a foam or an unfoamed solid, to impart properties of cushioning, responsiveness, and energy distribution to the foot of the wearer. For example, the sole structure 102 may include the cushioning element 204. The cushioning element 204 may comprise a foam. The foam may comprise a material. Example materials for the alternate cushioning element 204 may include those based on foaming or molding material, e.g. a resilient material, comprising one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the material is a thermoplastic material when it is combined with other elements to make the midsole, sole structure, or article of footwear, and remains thermoplastic, and is a thermoplastic material in the final product (e.g., in the finished midsole, finished sole structure or finished article of footwear). In other aspects, the material is a thermoplastic material when it is combined with other elements to make the midsole, sole structure, or article of footwear, and is subsequently cured into a crosslinked material in the manufacturing process, and thus is a crosslinked material in the final product. In yet other aspects, the material is crosslinked before being combined with other elements of the midsole, sole structure or article of footwear during the manufacturing process, and thus is a crosslinked material in the final product.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for barrier films 242 and 244. Alternatively, the one or more polymers may include one or more natural and/or synthetic rubbers, such as polybutadiene and polyisoprene.

In one aspect, the resilient material is a foam. When the material is foamed, the resilient material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foam may be a crosslinked foam. In these embodiments, a peroxide-based crosslinking agent such as dicumyl peroxide may be used. Furthermore, the foam may include one or more fillers such as pigments, modified or natural clays, modified or unmodified synthetic clays, talc glass fiber, powdered glass, modified or natural silica, calcium carbonate, mica, paper, wood chips, and the like.

In another example, when the resilient material is a foam, the material may be foamed during a molding process, such as an injection molding process. A thermoplastic material may be melted in the barrel of an injection molding system and combined with a physical or chemical blowing agent and optionally a crosslinking agent (in order to make a crosslinked foam), and then injected into a mold under conditions which activate the blowing agent, forming a molded foam.

Optionally, when the resilient material is a foam, the foam may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a material, e.g. a resilient material, by forming foamed particles or beads, by cutting foamed sheet stock, and the like. The compression molded foam may then be made by placing the one or more foam preforms in a compression mold, and applying sufficient pressure to the one or more preforms to compress the one or more foam preforms in a closed mold. Once the mold is closed, sufficient heat and/or pressure is applied to the one or more foam preforms in the closed mold for a sufficient duration of time to alter the foam preform(s), to form a skin on the outer surface of the compression molded foam, or to fuse individual foam particles to each other, to permanently or semi-permanently increase the density of the foam(s), or any combination thereof. Following the heating and/or application of pressure, the mold is opened and the molded foam article is removed from the mold.

In another aspect, the resilient material is an unfoamed solid. The material may be shaped using a molding process, including an injection molding process. In one example, when the material is an elastomeric material, the elastomeric material (e.g., uncured rubber) may be mixed in a Banbury mixer with an optional filler and a curing package such as, for example, a UV curing package or a thermal curing package including a sulfur-based or peroxide-based curing package, calendared, formed into shape, placed in a mold, and cured (e.g., using a UV curing process or a thermal curing process such as a vulcanization process).

The following clauses provide an exemplary configuration for an article of footwear and sole structure described above.

Clause 1. An article of footwear comprising: an upper; a sole structure, wherein the sole structure includes: a midsole, wherein the midsole includes an enclosed cavity; a thermoformed cushioning element disposed within the enclosed cavity, wherein the cushioning element includes a first barrier film and a second barrier film enclosing an internal volume; an outsole layer, wherein the outsole layer forms a ground-engaging surface of the article of footwear.

Clause 2. The article of footwear of clause 1, wherein the midsole includes a first window extending along a medial side of an exterior of the sole structure, and a second window extending along a lateral side of an exterior of the sole structure.

Clause 3. The article of footwear of clause 2, wherein the midsole further includes a first foam and a second foam, wherein the cavity is defined by the first foam, the second foam, the first window, and the second window.

Clause 4. The article of footwear of clause 3, wherein the first foam contacts a top surface of the cushioning element, and the second foam contacts a bottom surface of the cushioning element.

Clause 5. The article of footwear of clause 2, wherein the cushioning element includes: a medial body extending from a first anterior medial end to a second posterior medial end, and disposed adjacent to the first window; a lateral body extending from a first anterior lateral end to a second posterior lateral end, and disposed adjacent to the second window; one or more central bodies disposed between the medial body and the lateral body extending in a medial direction and a lateral direction; and a web area interconnecting disposed between the medial body, the lateral body, and the one or more central bodies.

Clause 6. The article of footwear of clause 5, wherein the medial body, the lateral body, and the one or more central bodies, are fluid-filled.

Clause 7. The article of footwear of clause 6, wherein the medial body, the lateral body, and the one or more central bodies, are all in fluid communication with one another.

Clause 8. The article of footwear of clause 5, wherein the first barrier film and the second barrier film are coupled to one another at a peripheral seam disposed around an exterior of the medial body and the lateral body of the cushioning element.

Clause 9. The article of footwear of clause 8, wherein no portion of the peripheral seam is visible from the exterior of the article of footwear, through either the lateral window or the medial window.

Clause 10. The article of footwear of clause 5, wherein the first barrier film and the second barrier film are also coupled to one another at the web area disposed between the medial body, the lateral body, and the one or more central bodies, wherein the web area is positioned in a plane offset from a plane containing substantially all of the peripheral seam.

Clause 11. The article of footwear of clause 5, wherein the only portions of the web area visible from exterior of the article of footwear and through either 1) the first window or the second window, are co-planar to one another.

Clause 12. The article of footwear of clause 2, wherein the first window and the second window each include a transparent material that is distinct from the cushioning element.

Clause 13. The article of footwear of clause 5, wherein each of the one or more central bodies is coupled to the medial body at a reduced diameter section.

Clause 14. The article of footwear of clause 13, wherein each of the one or more central bodies is coupled to the lateral body at a reduced diameter section.

Clause 15. The article of footwear of clause 5, wherein the medial body and the lateral body are substantially J-shaped.

Clause 16. The article of footwear of clause 5, wherein the medial body and the lateral body are mirror images of one another.

Clause 17. The article of footwear of clause 5, wherein the one or more central bodies includes exactly four central bodies.

Clause 18. The article of footwear of clause 5, wherein a hollow interior of each of the one or more central bodies is visible from exterior of the article of footwear, through each of the first window and the second window.

Clause 19. An article of footwear comprising: an upper; a sole structure, wherein the sole structure includes: a midsole, wherein the midsole includes an enclosed cavity; a cushioning element disposed within the enclosed cavity, wherein the cushioning element includes a first barrier film and a second barrier film enclosing an internal volume, wherein the first barrier film and the second barrier film are coupled to one another at a peripheral seam that extends along an outer surface of the cushioning element; a first window extending along a medial side of the sole structure; a second window extending along a lateral side of the sole structure, wherein the peripheral seam is positioned below bottom surfaces of the first window and the second window; and an outsole layer, wherein the outsole layer forms a ground-engaging surface of the article of footwear.

Clause 20. A cushioning element for an article of footwear, the cushioning element comprising: a first barrier film and a second barrier film enclosing an internal volume, a medial body extending from a first anterior medial end to a second posterior medial end; a lateral body extending from a first anterior lateral end to a second posterior lateral end; one or more central bodies disposed between the medial body and the lateral body extending in a medial direction and a lateral direction; and wherein the first barrier film and the second barrier film are coupled to one another at 1) a peripheral seam that extends along an outer surface of the cushioning element, the peripheral seam being positioned substantially in a first plane, and 2) at a web area disposed between the medial body, the lateral body, and the one or more central bodies, wherein the web area is disposed in a second plane that is offset from the first plane.

Clause 21. The cushioning element of clause 20, wherein the first barrier film and the second barrier film each includes a multi-layer film.

Clause 22. The cushioning element of clause 20, wherein the medial body, the lateral body, and the one or more central bodies, are fluid-filled.

Clause 23. The cushioning element of clause 22, wherein the medial body, the lateral body, and the one or more central bodies, are all in fluid communication with one another.

Clause 24. The cushioning element of clause 20, wherein the first barrier film and the second barrier film are coupled to one another at a peripheral seam disposed around an exterior of the medial body and the lateral body of the cushioning element.

Clause 25. The cushioning element of clause 20, wherein the first barrier film and the second barrier film are also coupled to one another at the web area disposed between the medial body, the lateral body, and the one or more central bodies, wherein the web area is positioned in a plane offset from a plane containing substantially all of the peripheral seam.

Clause 26. The cushioning element of clause 20, wherein each of the one or more central bodies is coupled to the medial body at a reduced diameter section, the reduced diameter section being an area with a diameter of a medial end of the one or more central bodies being less than a diameter of a portion of the medial body.

Clause 27. The cushioning element of clause 26, wherein each of the one or more central bodies is coupled to the lateral body at a reduced diameter section, the reduced diameter section being an area with a diameter of a lateral end of the one or more central bodies being less than a diameter of a portion of the lateral body.

Clause 28. The cushioning element of clause 20, wherein the medial body and the lateral body are substantially J-shaped.

Clause 29. The cushioning element of clause 20, wherein the medial body and the lateral body are mirror images of one another.

Clause 30. The cushioning element of clause 20, wherein the one or more central bodies includes exactly four central bodies.

Clause 31. The cushioning element of clause 21, wherein the multi-layer film includes a plurality of layers.

Clause 32. The cushioning element of clause 31, wherein the plurality of layers ranges from 5 layers to 400 layers.

Clause 33. The cushioning element of clause 32, wherein each of the plurality of layers has a thickness between 40 micrometers to 500 micrometers.

Clause 34. A sole structure comprising the cushioning element according to any one of clauses 20-33.

Clause 35. An article of footwear comprising the sole structure of clause 34.

Clause 36. A method of manufacturing a cushioning element, the method comprising: molding a first barrier film and a second barrier film via one or more mold portions; bonding the first barrier film and the second barrier to form a web area and a peripheral seam, wherein the web area is positioned in a plane offset from a plane containing substantially all of the peripheral seam; heating the first barrier film and the second barrier film; and forcing the first barrier film and the second barrier film into contact with the one or more mold portions.

Clause 37. A cushioning element manufactured by the method of clause 36.

Clause 38. A sole structure manufactured by coupling the cushioning element of clause 37 with a midsole.

Clause 39. An article of footwear manufactured by coupling the sole structure of clause 38 with an upper.

We claim:

1. An article of footwear comprising:

an upper;

a sole structure, wherein the sole structure includes:

a midsole, wherein the midsole includes an enclosed cavity and at least one window extending between top and bottom planes that are offset from one another by a gap;

a thermoformed cushioning element disposed within the enclosed cavity, wherein the cushioning element includes a first barrier film and a second barrier film coupled to one another at a peripheral seam enclosing an internal volume, the peripheral seam formed at a side of the thermoformed cushioning element which is proximate the at least one window, wherein the peripheral seam is disposed outside of the gap such that the peripheral seam is not visible through the at least one window; and an outsole layer, wherein the outsole layer forms a ground-engaging surface of the article of footwear.

2. The article of footwear of claim 1, wherein the midsole includes a first window extending along a medial side of an exterior of the sole structure, and a second window extending along a lateral side of an exterior of the sole structure.

3. The article of footwear of claim 2, wherein the midsole further includes an first foam and a second foam, wherein the cavity is defined by the first foam, the second foam, the first window, and the second window.

4. The article of footwear of claim 3, wherein the first foam contacts an outer surface of the cushioning element, and the second foam contacts a different part of the outer surface of the cushioning element than the first foam.

5. The article of footwear of claim 2, wherein the cushioning element includes:

a medial body extending from a first anterior medial end to a second posterior medial end, and disposed adjacent to the first window;

a lateral body extending from a first anterior lateral end to a second posterior lateral end, and disposed adjacent to the second window;

one or more central bodies disposed between the medial body and the lateral body extending in a medial direction and a lateral direction; and a web area disposed between the medial body, the lateral body, and the one or more central bodies.

6. The article of footwear of claim 5, wherein the medial body, the lateral body, and the one or more central bodies, are fluid-filled.

7. The article of footwear of claim 6, wherein the medial body, the lateral body, and the one or more central bodies, are all in fluid communication with one another.

8. The article of footwear of claim 5, wherein the first barrier film and the second barrier film are coupled to one another at a peripheral seam disposed around an exterior of the medial body and the lateral body of the cushioning element.

9. The article of footwear of claim 8, wherein no portion of the peripheral seam is visible from the exterior of the article of footwear, through either the lateral window or the medial window.

10. The article of footwear of claim 5, wherein the first barrier film and the second barrier film are also coupled to one another at the web area disposed between the medial body, the lateral body, and the one or more central bodies, wherein the web area is positioned in a plane offset from a plane containing substantially all of the peripheral seam.

11. The article of footwear of claim 5, wherein the only portions of the web area visible from exterior of the article of footwear and through either the first window or the second window are co-planar to one another.

12. The article of footwear of claim 5, wherein each of the one or more central bodies is coupled to the medial body at a reduced diameter section.

13. The article of footwear of claim 12, wherein each of the one or more central bodies is coupled to the lateral body at a reduced diameter section.

14. The article of footwear of claim 5, wherein the medial body and the lateral body are substantially J-shaped.

15. The article of footwear of claim 5, wherein the medial body and the lateral body are mirror images of one another.

16. The article of footwear of claim 5, wherein the one or more central bodies includes exactly four central bodies.

17. The article of footwear of claim 5, wherein a hollow interior of each of the one or more central bodies is visible from exterior of the article of footwear, through each of the first window and the second window.

18. The article of footwear of claim 2, wherein the first window and the second window each include a transparent material that is distinct from the cushioning element.

19. An article of footwear comprising:

an upper;

a sole structure, wherein the sole structure includes:

a midsole, wherein the midsole includes an enclosed cavity;

a cushioning element disposed within the enclosed cavity, wherein the cushioning element includes an first barrier film and a second barrier film enclosing an internal volume, wherein the first barrier film and the second barrier film are coupled to one another at a peripheral seam that extends along a side surface of the cushioning element;

a first window extending along a medial side of the sole structure; a second window extending along a lateral side of the sole structure, wherein the peripheral seam is positioned below bottom surfaces of the first window and the second window, wherein the side surface of the cushioning element is proximate the first window; and an outsole layer, wherein the outsole layer forms a ground-engaging surface of the article of footwear.

20. A cushioning element for an article of footwear, the cushioning element comprising:

a first barrier film and a second barrier film enclosing an internal volume;

a medial body extending from a first anterior medial end to a second posterior medial end;

a lateral body extending from a first anterior lateral end to a second posterior lateral end;

one or more central bodies disposed between the medial body and the lateral body extending in a medial direction and a lateral direction; and wherein the first barrier film and the second barrier film are coupled to one another at 1) a peripheral seam that extends along a side surface of the cushioning element, the peripheral seam including a first substantially flat section positioned substantially in a first plane, a second substantially flat section positioned in a second plane offset from the first plane, and an angled section positioned between the first substantially flat section and the second substantially flat section and 2) at a web area disposed between the medial body, the lateral body, and the one or more central bodies, wherein the web area is disposed in a second plane that is offset from the first plane.

* * * * *